United States Patent [19]

Schulte

[11] 3,985,245

[45] Oct. 12, 1976

[54] ARRANGEMENT FOR CHARGING THE COAL BINS OF HOPPER CARS

[75] Inventor: Fritz Schulte, Meerbusch, Germany

[73] Assignee: Hartung, Kuhn & Co. Maschinenfabrik GmbH, Dusseldorf, Germany

[22] Filed: Jan. 29, 1975

[21] Appl. No.: 544,619

[30] Foreign Application Priority Data

Jan. 31, 1974 Germany ..... 2404646

[52] U.S. Cl. ..... 214/41 R; 141/388; 193/30

[51] Int. Cl.[2] ..... B65G 67/06

[58] Field of Search ..... 214/17 B, 18 PH, 41, 214/35 R; 193/30; 141/312, 388

[56] References Cited

UNITED STATES PATENTS

| | | | |
|---|---|---|---|
| 1,422,997 | 7/1922 | McGregor | 214/41 X |
| 1,824,853 | 9/1931 | Wells | 214/18 PH |
| 3,411,462 | 11/1968 | Mathison | 214/17 B X |

*Primary Examiner*—Robert G. Sheridan
*Attorney, Agent, or Firm*—Michael J. Striker

[57] ABSTRACT

Arrangement for charging the coal bins of hopper cars for coke oven batteries employing a telescoping sealing device with a lead aperture for the coal, for a dust-free connection between the charging hoppers in the filling position and the weighing bunkers, thus enabling the use of pre-heated or wet coal, maintaining short charging cycles, and permitting an exact determination of the charging volume needed, based on the weight of the coal.

10 Claims, 4 Drawing Figures

ARRANGEMENT FOR CHARGING THE COAL BINS OF HOPPER CARS

FIELD OF THE INVENTION

The invention relates to an arrangement for charging the coal bins of hopper cars for coke oven batteries with preferably preheated coal, employing a hot-coal bunker and beneath the same weighing bunkers for loading with coal until a certain weight has been reached corresponding to the filling capacity of a furnace chamber.

DESCRIPTION OF THE PRIOR ART

In discharging the hot coal from the bunkers into the charging hoppers of hopper cars, considerable difficulties are encountered due to the developement of dust caused by the discharge, because the air displaced by the hot coal carries large amounts of coal dust and as a result pollutes the surrounding atmosphere to a considerable extent.

It is the object of the invention to provide an arrangement enabling filling of charging hoppers of hopper cars with a specified amount of wet coal already weighed, particularly however, with preheated coal, which makes it possible to maintain short charging cycles and to protect the atmosphere surrounding the arrangement from harmful gases.

SUMMARY OF THE INVENTION

The invention offers a solution by having the charging hoppers of a hopper car in the filling position connected to the weighing bunkers by a telescoping sealing device that can be moved up and down, said sealing device provided with a lead aperture for the coal.

According to one embodiment of the invention, a tubular discharge connecting piece of the weighing bunker is attached in a tight fit to the inside rim of a flexible annular sealing member, its outer rim connected in a tight fit to a horizontal annular plate movably surrounding the discharge connecting piece of the weighting bunker and provided at its bottom side with an annular gasket, which by means of pressure-medium cylinders can be placed in a sealing position onto the top plane of a sealing surface surrounding the port of the charging hopper, the piston rods of said cylinders flexibly engaging brackets evenly distributed over the circumference of a tubular wall and the cylinder side connected to brackets attached to the outer surface of the weighing bunker. In this arrangement a suction pipe line is connected to the tubular wall projecting away from the movable annular plate, whereby the outer rim of the sealing member is attached to the top end of said wall.

According to another embodiment of the invention, each charging hopper is provided with an upward projecting cylindrical short pipe connection attached in a tight fit at its top end to the outer rim of a flexible annular sealing member, the inner rim of said member attached in a tight fit to the outer surface of a transfer tube stud. An annular flange extends from the upper rim of said tube stud horizontally and radially toward the outside, said flange supporting an annular gasket at its top surface. The piston rods of the pressure-medium cylinders engage at least at three points provided across the circumference of the annular plate, said pressure-medium cylinders extending in vertical direction downward and each being flexibly attached to the hopper car bin at the cylinder side such, that the annular flange with its gasket can be moved to seal the bottom plane of an annular surface surrounding the discharge port of the weighing bunker. In this arrangement the annular flange supporting the annular gasket carries along a tubular section on its bottom plane, which section overlaps the cylindrical portion of the hopper car bin that projects upward. Beyond this, it is provided a suction port within the circuit of contact of the annular seal at the sealaing surface, said port connected to a suction pipe line.

In the case of both embodiments, it is advisable to connect the suction pipe line to a dust removal cyclone coupled at the outlet side to wet cleaning equipment for dust-laden gases.

DESCRIPTION OF THE DRAWINGS

The description refers to the accompanying drawings in which like reference characters refer to like parts throughout the several views, and in which.

DESCRIPTION OF THE PREFERRED EMBODIMENTS

Figure 1A:
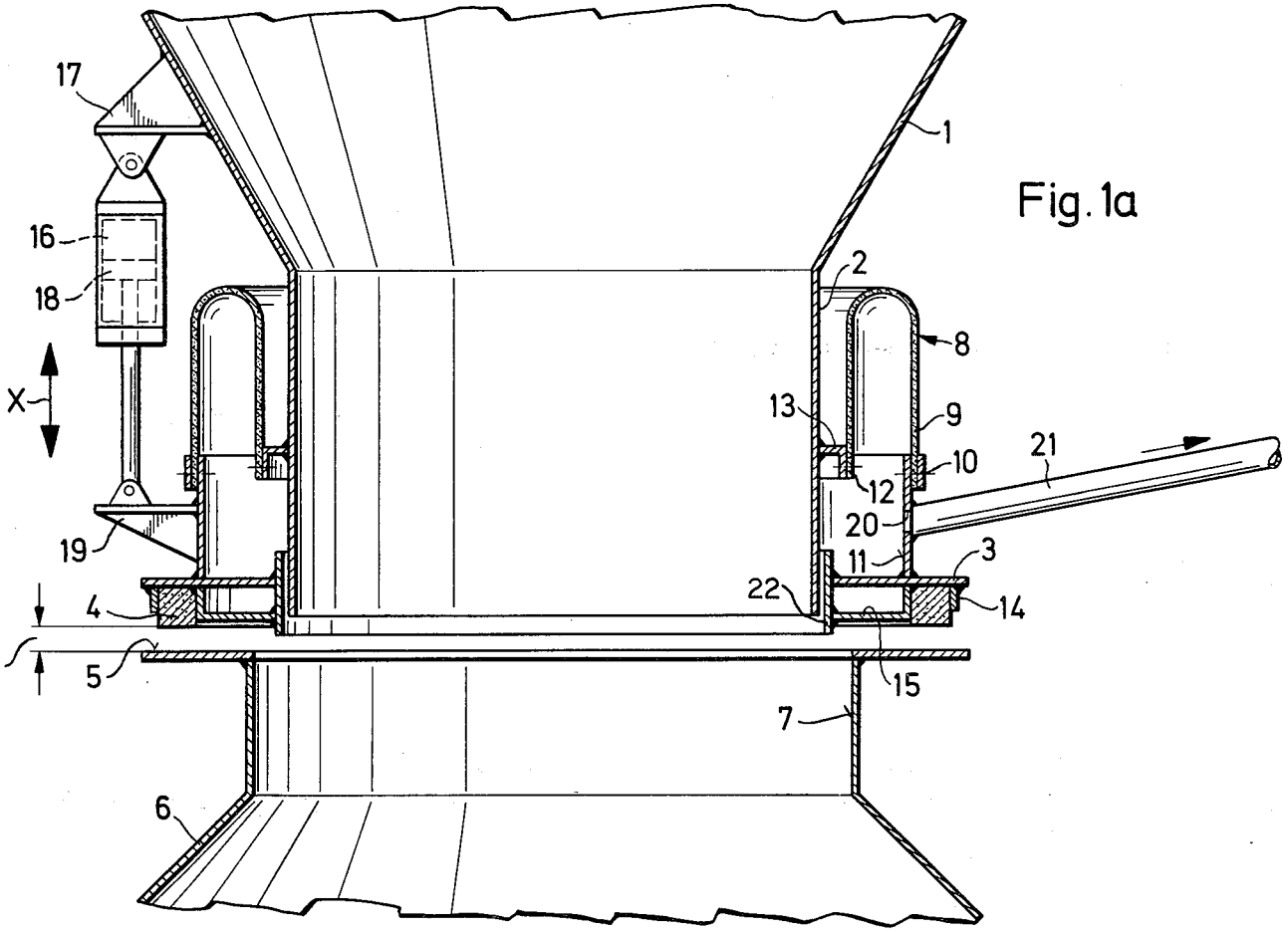
FIG. 1*a* shows a vertical section through the apparatus of the invention illustrating its open position.

Now referring to the drawings, the invention is described with reference to an arrangement for charging the coal bins of hopper cars for coke oven batteries with preferably preheated, but also with wet coal. The weighing bunkers are adapted for loading the coal until a certain weight is reached corresponding to the filling capacity of a furnace chamber and, are arranged beneath a hot-coal bunker not illustrated.

In accordance with the invention, the charging hoppers of a hopper car in the filling position shown in the Figures are connected to the weighing bunkers by a telescoping sealing device that can be moved up and down, said sealing device provided with a lead aperture for the coal.

Figure 1B:
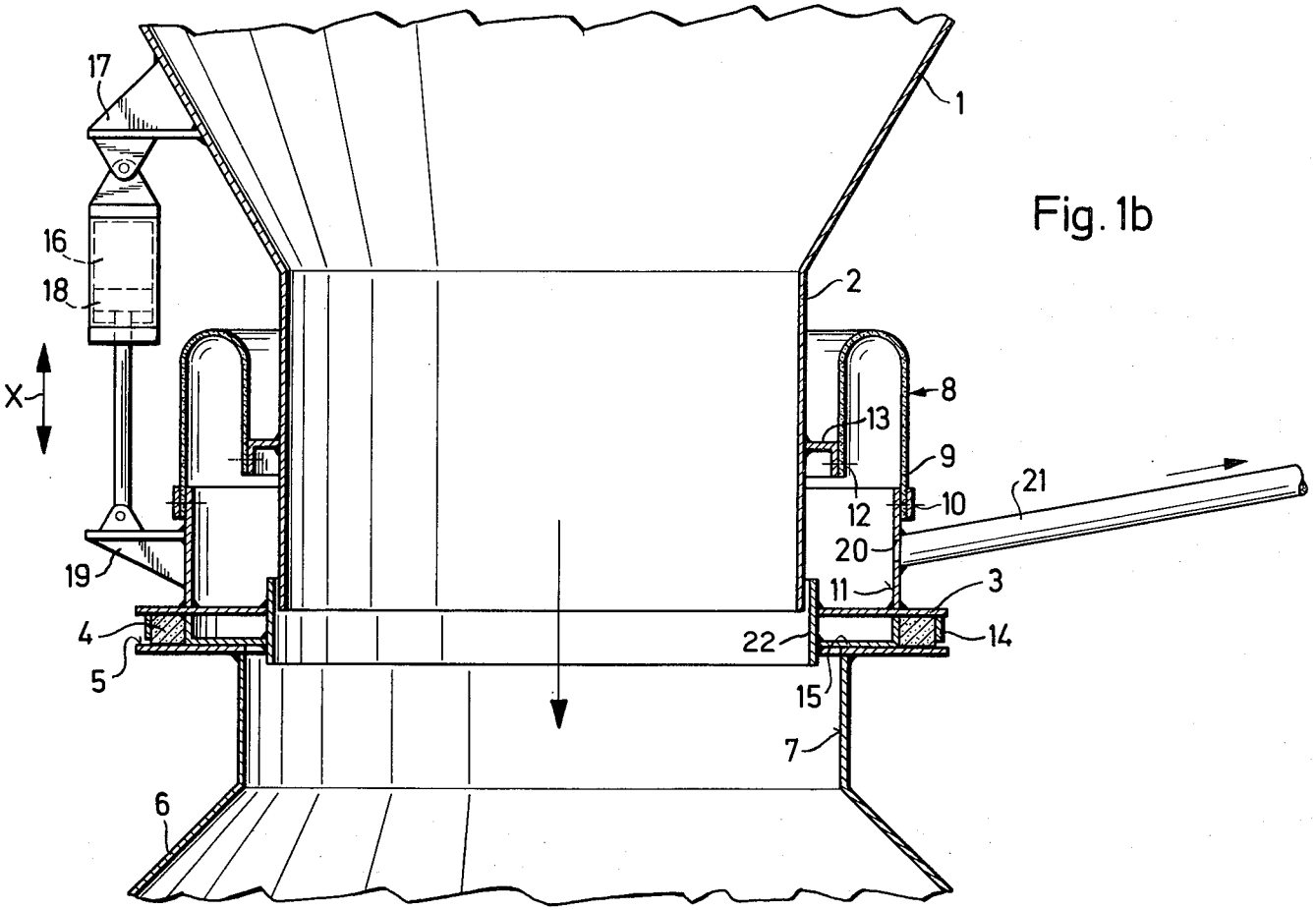
FIG. 1*b* represents a vertical section through the same apparatus in its closed position.

FIGS. 1*a* and 1*b* show a weighing bunker 1 which extends in a downward direction as tubular discharge connecting piece 2. An annular plate 3 is positioned at the outside of this discharge connecting piece such that it can be moved up and down. The annular plate is provided at its bottom side with an annular gasket 4. A horizontal annular flange 5 is provided around the a coal hopper 6 associated with a hopper car not illustrated, which said annular flange surrounds a cylindrical port 7 of the charging hopper.

Annular plate 3 is connected to the tubular discharge connecting piece 2 by means of an annular flexible sealing member 8, whose outer rim 9 sealingly engages the top end of a tubular wall 11 attached to the top surface of annular plate 3 and projecting upward therefrom. The inner rim 12 of the flexible sealing member is attached to the one leg of an annular shoulder 13 solidly welded to the short discharge connecting piece 2 at about the middle of its outer side.

Annular gasket 4 is bordered at the outside by a downward pointing annular collar 14 and at the inside by a supporting ring 15, onto which annular plate 3, as shown in the lowered position illustrated in FIG. 1*b*, is supported by annular flange 5 of the charging coal hopper 6, such that gasket 4 rests on sealing flange 5 under a certain amount of pre-tension, and the outer annular collar 14 is located a suitable distance above sealing flange 5.

The up and down movement of annular plate 3 is conducted by pressure-medium cylinder 16 which can be acted upon alternately. At least three such cylinders are distributed at the same angular distances over the circumference of the weighing bunker 1 and of the tubular wall 11. The cylinder ends of pressure-medium cylinders 16 are flexibly connected to brackets 17 attached to the outer surface of the weighing bunker, whereas piston rods 18 are supported by brackets 19 attached to the outer surface of tubular wall 11. By a corresponding action on the pressure-medium cylinders, annular plate 3 can be moved in the direction of arrows X either up or down as soon as the coal bin of the hopper car is located in a charging position.

Tubular wall 11 is provided with a suction port 20 to which suction pipe line 21 is attached, said pipe line is connected to a dust removal cyclone coupled at the outlet side to wet cleaning equipment having a stationary location in the vicinity of the hot-coal bunker (these stations not shown).

Figure 2A:
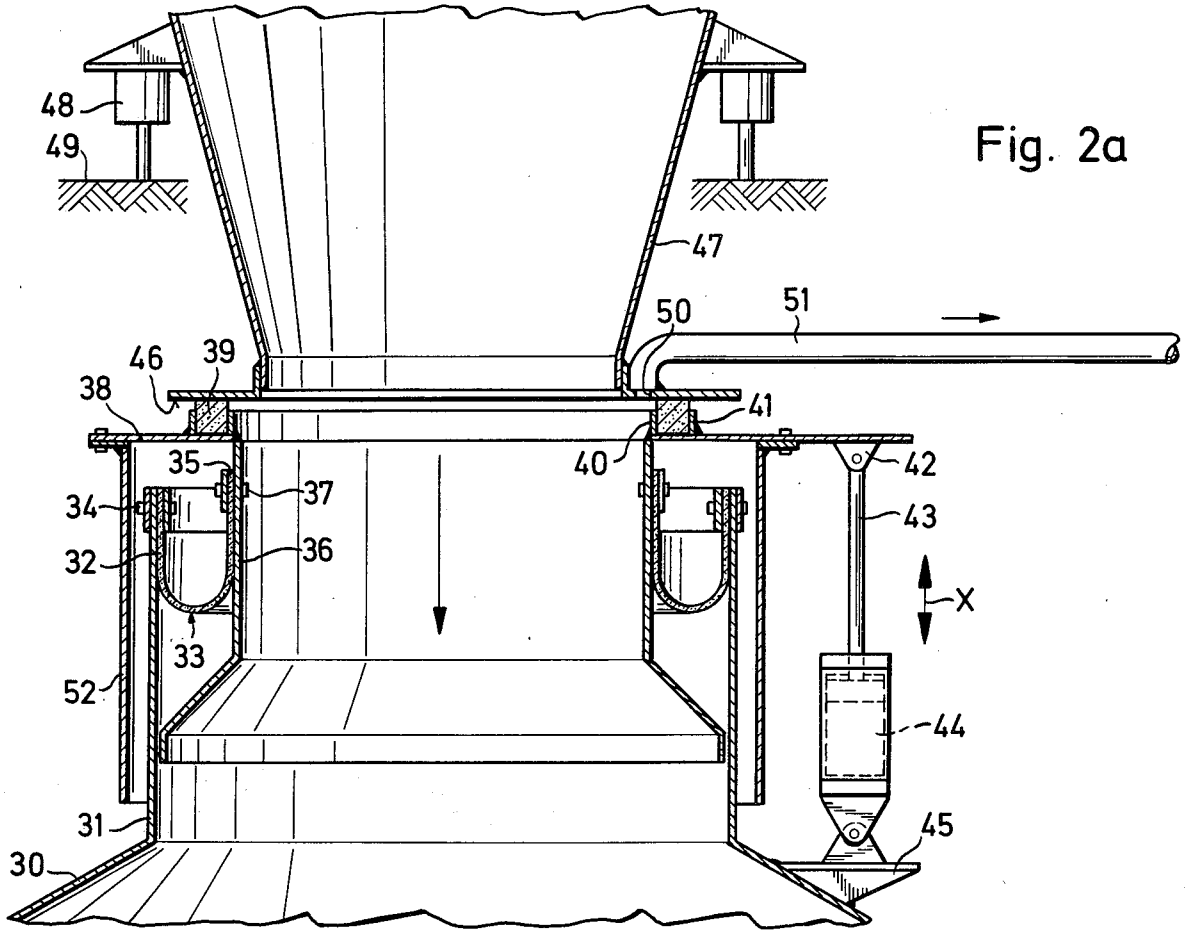
FIG. 2*a* represents a vertical section through another embodiment of the invention showing it in a closed position.
Figure 2B:
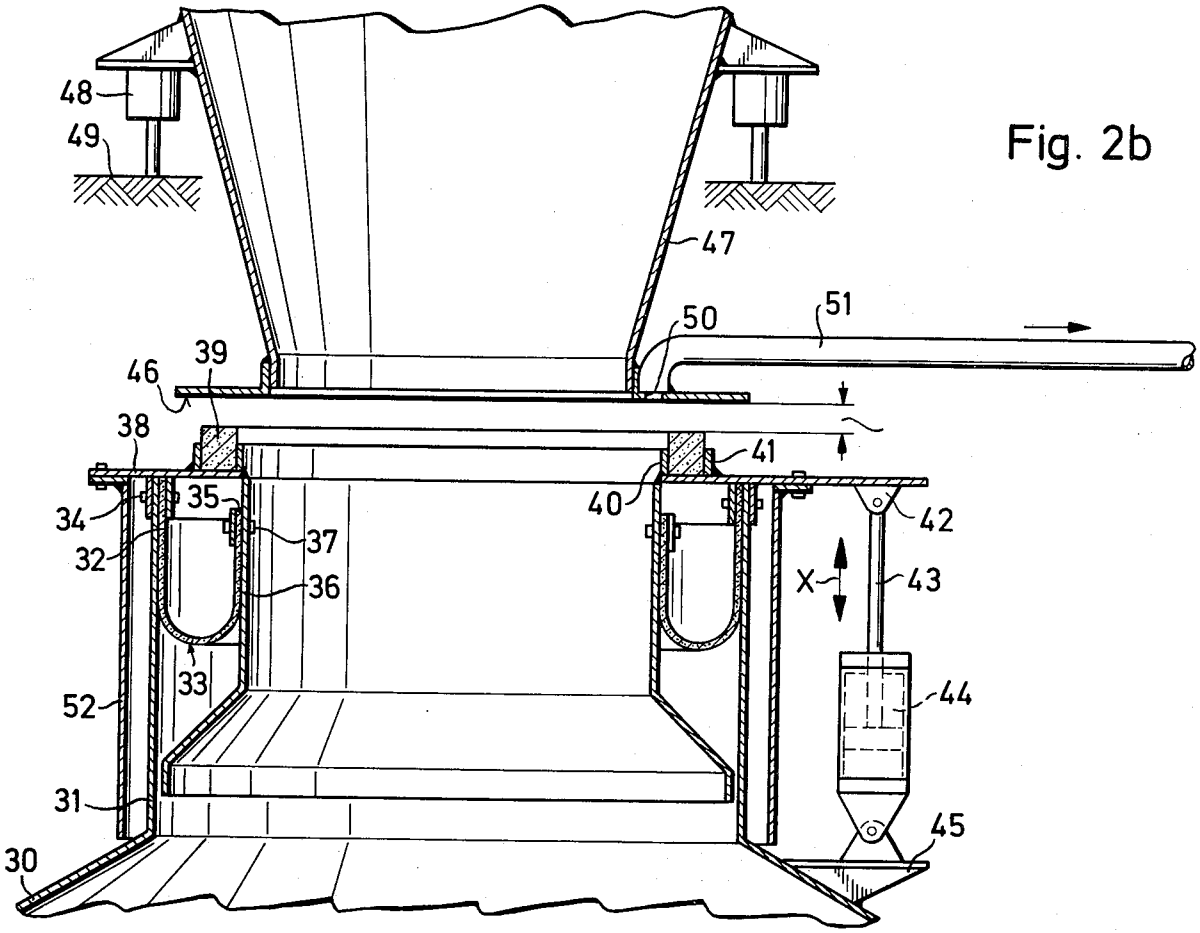
FIG. 2*b* is a vertical section illustrating the same embodiment in an open position.

FIGS. 2*a* and 2*b* illustrate an embodiment in which a charging hopper 30 is provided with an upward projecting cylindrical short pipe connection 31, whose upper end is a tight fit at 34 with the outer rim 32 of a flexible annular sealing member 33. The inner rim 35 of the sealing member is attached at 37 in a tight fit to the outer surface of a transfer tube 36. Annular flange 38 extends radially outward from the top rim of tube 36, the plate supporting an annular gasket 39 at its top surface, said gasket is bordered on the inside and outside by annular collars 40, 41. A cylindrical protective sleeve 52 for sealing member 33 overlaps the short cylindrical connecting piece 31 with radial clearance between the two, essentially over the full length of the connecting piece. At least at three points across the circumference of the annular flange, one such point being shown in FIGS. 2*a* and 2*b* as reference character 42, a piston rod 43 of a pressure-medium cylinder is engaged, said piston rod extending in vertical direction into a cylinder 44 being flexibly attached to brackets 45 at the cylinder side, fixed to the outer surface of charging hopper 30. By acting on the pressure-medium cylinder 44, annular plate 38 can be moved up and down, so that gasket 39, as shown in FIG. 2*a* is placed against the surface of an annual plate 46 which encloses the discharge port of a weighing bunker 47, said bunker, as illustrated in FIGS. 2*a* and 2*b* only as an example, being supported in known fashion through capsule-type dynamometers 48 on a base 49 of a structure not illustrated in detail.

A suction port 50 is provided in the annular plate 46 of the weighing bunker within the radius of annular gasket 39, through which port filling gasses may be removed via a suction pipe line to a dust removal cyclone coupled at the outlet side to wet cleaning equipment having a stationary location in the vicinity of the hot-coal bunker (these stations not illustrated).

In using the apparatus of the invention, it is possible to charge the furnace chambers of a coke oven battery by means of a single hopper car, whereby initially the hot coal is removed in known fashion from preheating equipment and transported by suitable conveying elements into hot-coal bunkers of a filling tower, which are not illustrated and which rest on pressure metering cells that control the coal output. Below these hot-coal bunkers are located the weighing bunkers shown in the Figures. The weighing bunkers also rest on pressure metering cells and are connected each to the hot-coal bunkers by means of bellows of suitable material, they can also be filled with coal from the hot coal bunkers by means of slowly moving rotating lock bucket wheels. The flexible connection between these two types of bunkers is dust-tight, on the other hand, it permits weighing of the weighing bunker including its contents. A coal trap of suitable construction is connected to the discharge end of the weighing bunker, said trap not illustrated in detail, whereby the arrangement of the invention permits a dust-free connection of the lower part of the weighing bunker to the respective hopper of the hopper car. The exact amount of coal needed for each hopper of the hopper car is already determined in the weighing bunker in this manner, and can be conveyed into the charging car hoppers in a dustproof manner. Since the specific weight of the preheated coal is constant within narrow limits, due to the uniform grain size distribution, it is possible to compute the volume on which charging the coke oven chambers depends, directly from the weight.

A charging cycle can be carried out with the apparatus described in accordance with the invention, such that hot-coal is conveyed to the weighing bunkers from the hot-coal bunkers containing a volume of coal corresponding to ca. 4–6 oven chambers being filled over a period of 4–8 minutes, depending upon the length of the oven cycle, whereby a known rotating lock bucket wheel not illustrated in the drawings, is halted by a signal from capsule-type dynamometers, once a predetermined nominal weight is reached. Thereafter, the hopper car is driven to the furnace chambers that are to be filled and the coal discharge into those chambers. Subsequently, the hopper car returns to the coal filling tower, is positioned beneath the weighing bunker so that the arrangement of the invention is put into operation by means of the pressure-medium cylinders and can produce the tight connection between the weighing bunker and the charging hopper. Thereafter, the coal trap of the weighing bunker is opened (the trap is not illustrated). Transfer of the coal from the weighing bunkers into the charging car hoppers can be accomplished in less than one minute, which is the time customarily needed for wet coal. During this transfer operation, the dust-laden air is displaced from the charging hoppers by the suction pipe lines mentioned and transported into a separating device, which separates the dust particles from the air by means of a ventilator attached to the coal filling tower. These dust particles can also be recycled to a charging car hopper.

Although my invention has been illustrated and described with reference to the preferred embodiments thereof, I wish to have it understood that it is in no way limited to the details of such embodiments but is capable of numerous modifications within the scope of the appended claims.

Having thus fully disclosed my invention, what I claim is:

1. An arrangement for charging, preferably with preheated coal, coal containers of charging cars for coke oven batteries, comprising in combination a hot coal bunker; an upper container positioned underneath said coal bunker and a lower coal container arranged on a charging car; said upper container having an inlet opening at its top and an outlet opening at its bottom and having an annular peripheral plate associated to the bottom side thereof; said lower coal container having at its top and inlet opening whose diameter substantially corresponds to that of the outlet opening of said upper container, and having a peripheral annular flange around the inlet opening thereof; an annular gasket sealing means being provided on the side of contact between said annular peripheral plate and said annular peripheral flange; a flexible annular sealing member being located proximate to the contact between said annular peripheral plate and said annular peripheral flange; a suction port being located proximate to the outlet opening of said upper container and being connected to an exhaust pipe of a dust separating device; vertically extending telescopable means being arranged to provide a vertical motion of at least one of said upper and lower containers in order to provide sealing contact on said gasket sealing means between said annular peripheral plate and said annular peripheral flange; and moving means operable to cause said telescopable means to extend or contract and thus to produce said vertical motion.

2. An arrangement as defined in claim 1, wherein said upper container is a weighing container and is arranged to receive coal of a specified weight corresponding to the charging amount of an oven chamber; a tubular discharge connecting piece is provided surrounding the lower portion of said weighing container; said annular peripheral plate extends from said discharge connecting piece and a tubular outer wall fixed to said annular peripheral plate extends upwardly therefrom in parallel relationship to the lower portion of said weighing container and surrounds the same; said annular gasket sealing means is provided at the lower side of said annular peripheral plate and is arranged to be opposite to said annular peripheral flange; said flexible annular sealing member has an outer rim and an inner rim, said rims being tightly connected, respectively to said tubular outer wall and said weighing container; said telescopable means includes at least three cylinders regularly distributed around the periphery of said weighing container; each of said cylinders contains a piston integral with a piston rod; said cylinders and piston rods are flexibly connected to brackets provided, respectively on said weighing container and said tubular discharge connecting piece; said moving means being arranged to cause synchronized vertical motion by said telescoping means of said tubular discharge connecting piece together with said tubular outer wall and said annular peripheral plate, so that a downward motion of said telescoping means lowers said annular gasket sealing means in a sealing engagement with the surface of said annular peripheral flange.

3. An arrangement as defined in claim 2, wherein said exhaust pipe has its suction port located in said tubular outer wall, so that it communicates with an annular space bound by said movable annular peripheral plate, said flexible sealing member, said outer tubular wall and said weighing container.

4. An arrangement as defined in claim 3, wherein said dust separating device is coupled at its outlet to a wet cleaning equipment for dustladen gases.

5. An arrangement as defined in claim 1, wherein said charging lower container is provided with an upwardly projecting cylindrical tubular connection; a transfer tube is provided inside said tubular connection; said peripheral annular flange extends radially outward from the top rim of said transfer tube; said annular gasket sealing means is located at the top surface of said annular peripheral flange; said flexible annular sealing is tightly connected at its outer rim and its inner rim, respectively, to said tubular connection and said transfer tube; a cylindrical outer wall extends downwardly from said annular peripheral flange, is affixed thereto, and surrounds in parallel relationship said tubular connection; said telescopable means includes at least three cylinders regularly distributed around the periphery of said cylindrical outer wall; each of said cylinders includes a piston integral with a piston rod; said cylinders and piston rods are connected to brackets provided, respectively, on said lower container and said annular peripheral flange; said moving means are adapted to cause synchronized vertical motion by said telescoping means of said lower container, said transfer tube and said outer cylindrical wall together with said annular flange, so that an upward motion of this telescopable means raises said annular gasket sealing means and brings the same in sealing engagement with the lower surface of said annular peripheral plate.

6. An arrangement as defined in claim 5, wherein said cylindrical outer wall overlaps said cylindrical connection of said lower container.

7. An arrangement as defined in claim 6, wherein said annular peripheral plate is affixed at the bottom of said upper container and said suction port is provided in said plate.

8. An arrangement as defined in claim 7, wherein said suction port is provided in said annular peripheral plate proximate to the space of contact of said annular gasket sealing means on said annular peripheral flange with said annular peripheral plate.

9. An arrangement as defined in claim 8, wherein said dust separating device is coupled at its outlet to a wet cleaning equipment for dust-laden gases.

10. An arrangement as defined in claim 9, wherein a plurality of capsule-type dynamometers are arranged in regular spacings around the periphery of said weighing upper container and are attached thereto to support it on a stationary basis.

* * * * *